US006260825B1

(12) United States Patent
Willis

(10) Patent No.: US 6,260,825 B1
(45) Date of Patent: Jul. 17, 2001

(54) STAPLE REMOVER AND METHOD

(76) Inventor: Walter A. Willis, 2404 NC Hwy. 62 South, Yanceyville, NC (US) 27379

( * ) Notice: Subject to any disclaimer, the term of this patent is extended or adjusted under 35 U.S.C. 154(b) by 0 days.

(21) Appl. No.: 09/444,235

(22) Filed: Nov. 22, 1999

(51) Int. Cl.[7] ..... B25C 11/00
(52) U.S. Cl. ..... 254/28; 254/21; 254/30
(58) Field of Search ..... 254/28, 30, 21; 173/169; 30/167, 277.4

(56) References Cited

U.S. PATENT DOCUMENTS

| | | | | |
|---|---|---|---|---|
| 3,231,972 | * | 2/1966 | Annese et al. | 30/277.4 |
| 3,310,288 | * | 3/1967 | Berry | 254/28 |
| 3,698,689 | * | 10/1972 | Poskin | 254/28 |
| 4,049,236 | * | 9/1977 | Grill et al. | 254/28 |
| 4,245,817 | | 1/1981 | Peoples . | |
| 4,304,047 | * | 12/1981 | Jesionowski | 30/277.4 |
| 4,466,851 | * | 8/1984 | Hoffman | 173/169 |
| 4,637,538 | * | 1/1987 | Wagner | 30/277.4 |
| 5,042,592 | * | 8/1991 | Fisher | 173/109 |
| 5,870,811 | * | 2/1999 | Ciok | 254/28 |

OTHER PUBLICATIONS

Superior Pneumatic & Mfg., Inc. brochure entitled Bantam Bully Air Hammer ©1998.

* cited by examiner

*Primary Examiner*—Joseph J. Hail, III
*Assistant Examiner*—Lee Wilson

(57) ABSTRACT

A staple removing tool is provided which can be attached to a power tool such as a pneumatic hammer gun or which can be used manually. The tool includes a shaft having a handle affixed at a right angle thereto and an angled tip to assist in prying. The method described using the tool which greatly increases the efficiency in removing stapled upholstery fabric from furniture frames and the like.

14 Claims, 4 Drawing Sheets

STAPLE REMOVER AND METHOD

FIELD OF THE INVENTION

The invention herein pertains to tools for use in reupholstering furniture and particularly provides a tool for insertion in a power tool such as an air hammer gun for removing conventional staples.

DESCRIPTION OF THE PRIOR ART AND OBJECTIVES OF THE INVENTION

Reupholstering furniture such as chairs, sofas and the like usually requires the removal of fabric and padding from a wooden frame which can be a time consuming and a labor intensive process. Most fabrics and other coverings such as vinyls, nylons and other synthetic fabrics are affixed to wooden frames by standard staples which have been set by manual, electric or hydraulic staple guns. Instruments that drive staples utilize a large force to drive the staples deeply into the wooden or other structures. Such methods of attaching fabrics and. coverings create a desirable attachment, however when such furniture needs reupholstering, a formidable task is presented to the worker to first remove the old staples and then remove the old fabrics, paddings and coverings. Various types of hand staple removers have been used in the past including screwdrivers and various manual staple removers. While such tools are helpful in reupholstering, the length of time can be extremely long, especially when a furniture frame is constructed of dense wood which causes a strong adhesion with the staple and the wood frame. Thus, there has been a long felt need in the furniture industry for a quick and efficient method of removing staples during the reupholstering process and it is one objective of the present invention to provide a power tool with a staple remover which can be used to quickly and easily remove staples from upholstered furniture without unduly tiring the operator.

It is yet another objective of the present invention to provide a staple remover which can be quickly inserted in an air hammer gun or other power tool to allow the operator to rotate the staple remover for convenience in use.

It is a further objective of the present invention to provide a method of removing a staple utilizing a power tool to efficiently remove staples from dense materials.

It is also an objective of the present invention to provide a staple remover which includes a handle to accurate guide the staple remover during use and to provide a twisting action during removal.

Various other objectives and advantages of the present invention will become apparent to those skilled in the art as a more detailed description is set forth below.

SUMMARY OF THE INVENTION

The aforesaid and other objectives are realized by providing a staple remover which includes a rigid shaft as formed from steel having in upwardly angled distal end for prying. The distal end is forked and includes a pair of sharpened tines. A rigid handle is affixed to the shaft approximately midway therealong for grasping and assisting in guiding the staple remover. One method of use includes inserting the proximal end of the shaft in a conventional power tool such as an air hammer gun which can be operated to direct a driving force through the staple remover to the staple. The staple remover can be rotated while attached to the air hammer gun so, for example as to allow the staple remover to be conveniently positioned as desired to extract a particular staple. The invention as described below allows a user to subject a set staple to a direct driving force, a vertical prying action and a lateral twisting motion as needed.

DETAILED DESCRIPTION OF THE PREFERRED EMBODIMENTS AND OPERATION OF THE INVENTION

Figure 1:
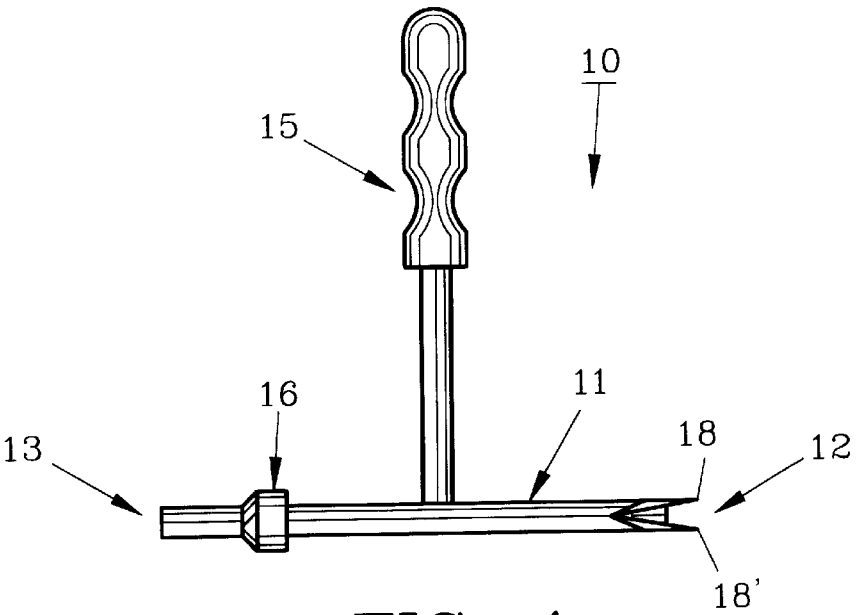
FIG. 1 demonstrates a top plan view of the staple remover of the invention.
Figure 2:
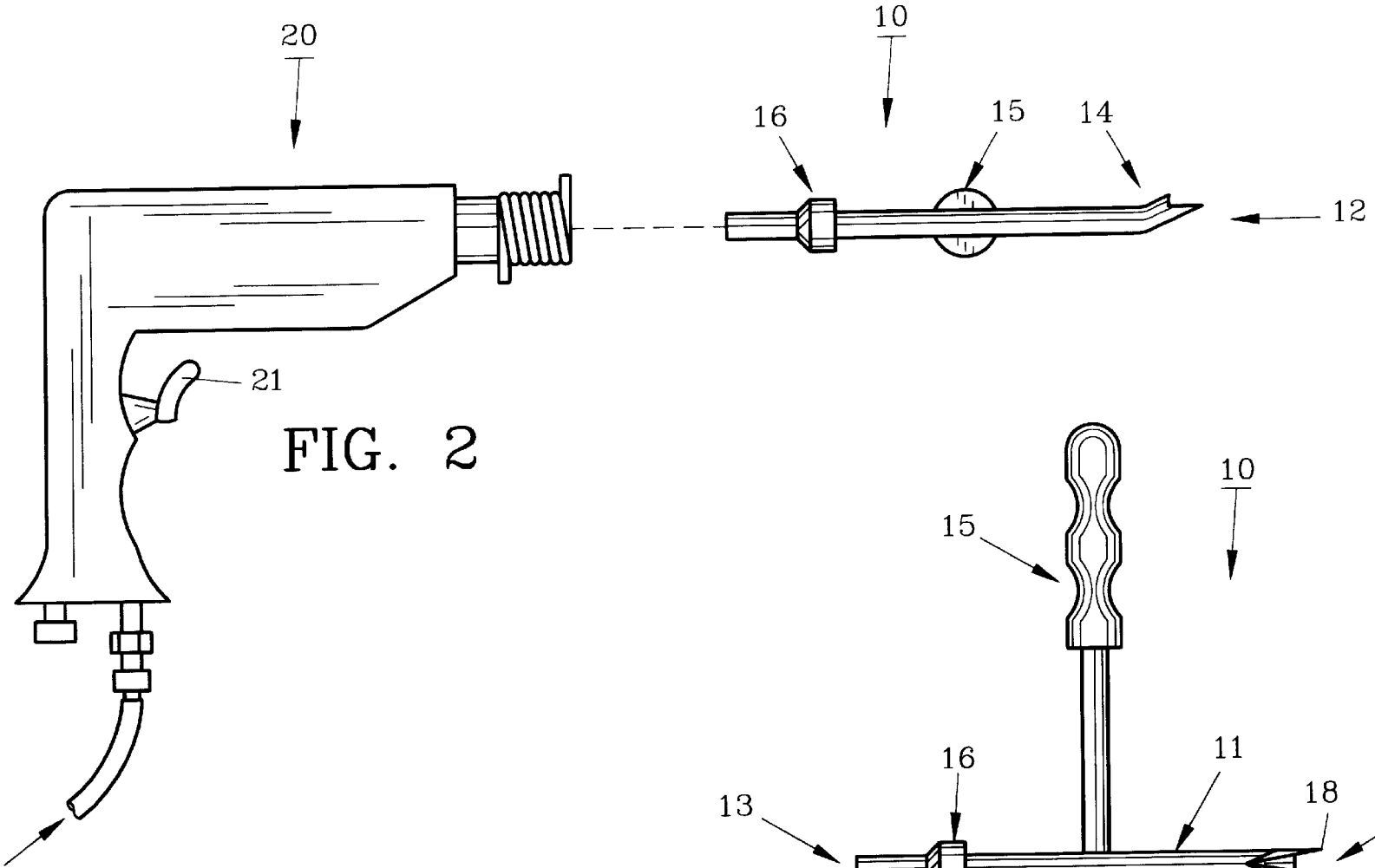
FIG. 2 features a side view of the staple remover exploded from a power tool.
Figure 3:
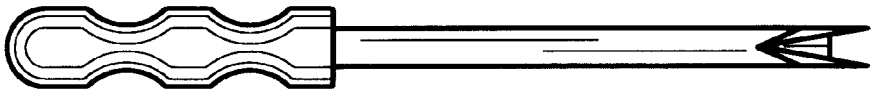
FIG. 3 shows a top view of an old manual staple remover.
Figure 4:
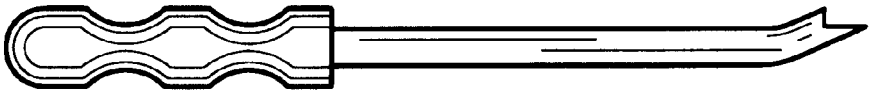
FIG. 4 PRIOR ART
FIG. 4 depicts a side view of the manual staple remover as shown in FIG. 3.

For a better understanding of the invention and its method of operation, turning now to the drawings, FIG. 1 demonstrates a top view of preferred staple remover 10 having a shaft 11 with distal end 12 and proximal end 13. Distal end 12 is angled upwardly at 14 as shown in FIG. 2 to create an upward bias for prying, if needed. Handle 15 is attached to shaft 11 such as by welding or may be integrally formed therewith. Along proximal end 13 circular stop 16 is affixed for mounting purposes when positioned in a conventional power tool such as air hammer gun 20. While staple remover 10 is illustrated herein as used with air hammer gun 20, other types of tools such as electric or other tools could also be employed. Also, staple remover 10 can be used as a manual tool alone, without an air hammer gun or other power tool As also shown in FIG. 1, distal end 12 includes a pair of sharply pointed tines 18, 18' as conventional are also seen in FIGS. 3 and 4 which demonstrate top and sides views respectively of standard manual staple removing tools as have been used for many years in the furniture upholstery industry.

Figure 5:
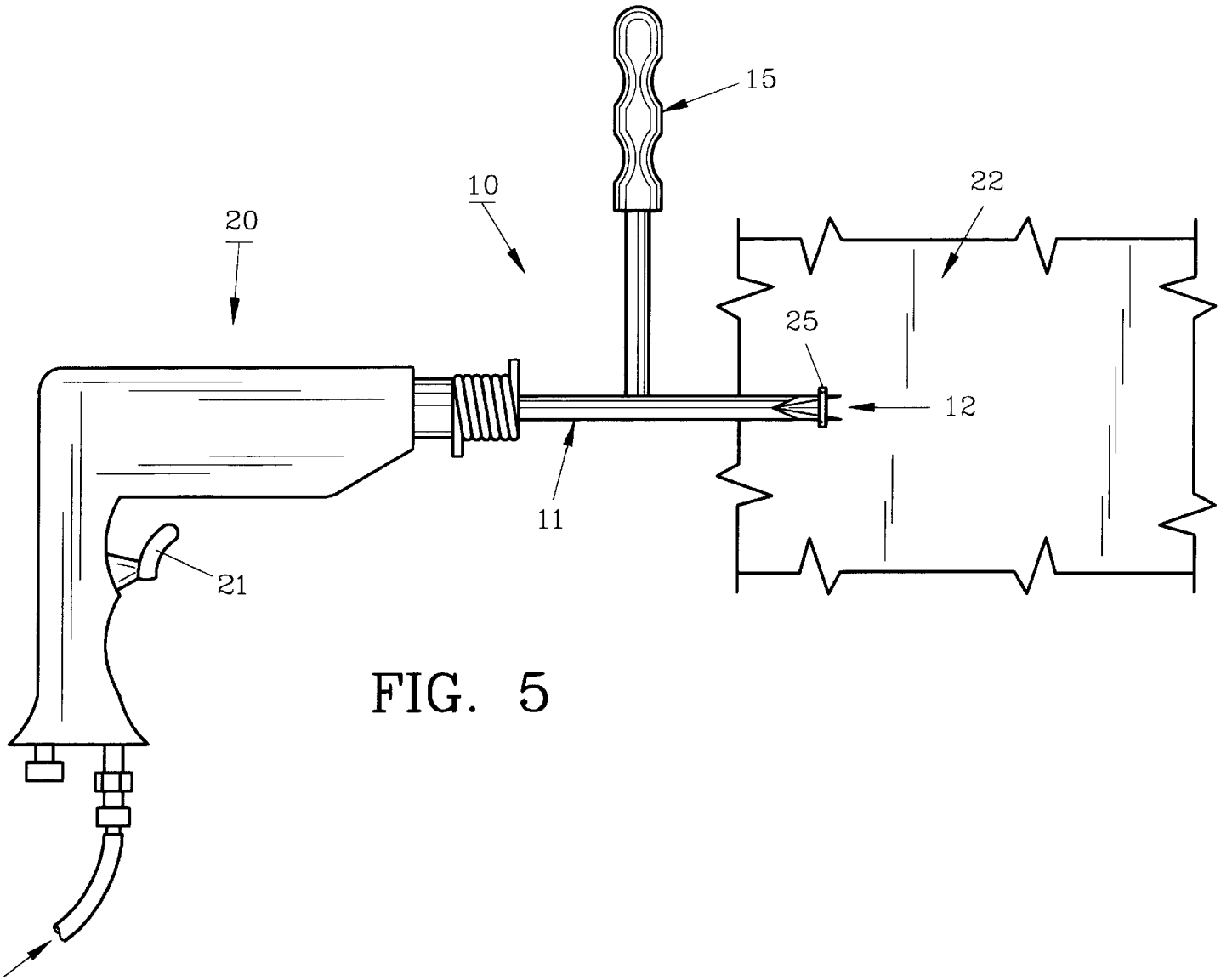
FIG. 5 shows the invention as used in extracting a staple from a vertical member.

In FIG. 5, staple remover 10 is mounted in air hammer gun 20 and is being used to remove a staple from vertical panel 22. Panel 22 may be for example, a side panel of a sofa, chair or other upholstered item. Handle 15 is positioned in a substantially upright vertical position while shaft 11 with distal end 12 engages staple 25 for removal.

Figure 7:
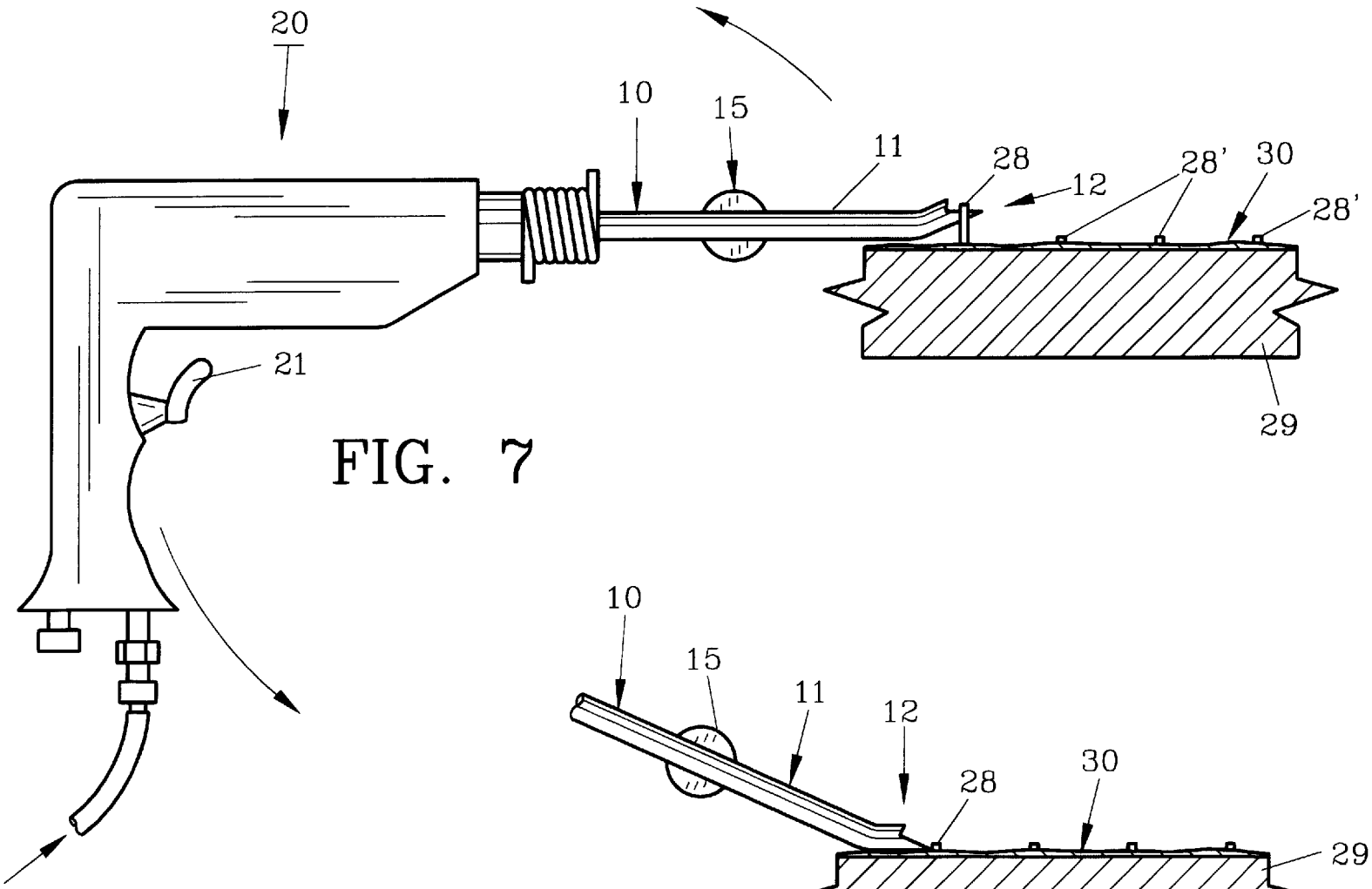
FIG. 7 demonstrates a later phase of removing the staple from the horizontal member of FIG. 6 while utilizing a prying action.
Figure 6:
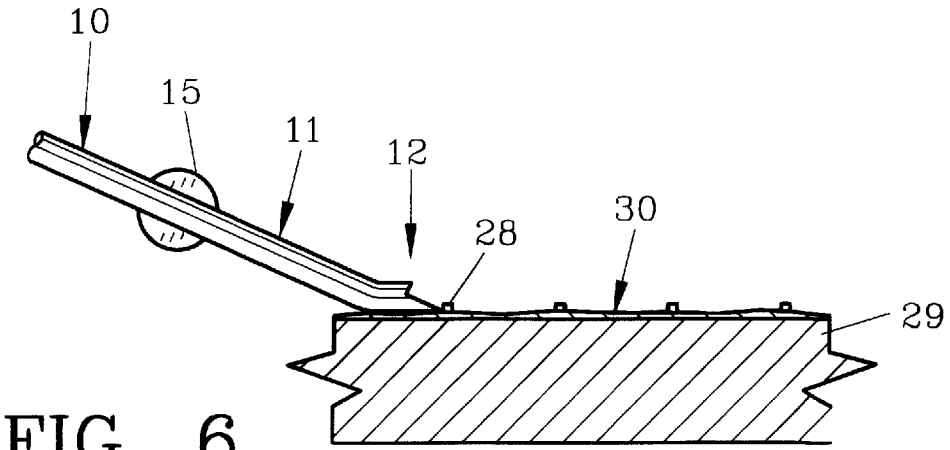
FIG. 6 pictures the initial step of removing a staple from a horizontal member.

In FIG. 6, staple 28 is contacted by distal end 12 of shaft 11 (seen in fragmented fashion) and in FIG. 7 has urged staple 28 outwardly from horizontal wooden furniture part 29 which is covered by fabric 30. As further shown, staples 28' (FIG. 7) are firmly set in wooden furniture part 29. In FIGS. 5 and 6, handle 15 is used to freely rotate shaft 11 360° for convenience while mounted within air hammer gun 20 for removing staples at any angle or position required, or to add torque (twist) to a stubborn staple during removal.

The preferred method of removing a conventional staple such as staple 28 shown in FIG. 6 includes the step of first, inserting shaft 11 into a tool such as air hammer gun 20. Next, air hammer gun 20 is grasped with, for example the right hand and simultaneously handle 15 of shaft 11 is grasped with the left hand. Distal end 12 of shaft 11 is then placed against staple 28. Then, by activating air hammer gun 20 (by pulling trigger 21) staple 28 is impacted with an adverse driving force and is quickly and efficiently loosened. Should staple 28 be extremely deep into furniture part 29 or if furniture part 29 is very dense, then distal end 12 would be first placed as in FIG. 6 against staple 28. Thereafter air hammer gun 20 is activated while rotating air hammer gun 20 downwardly as shown in the direction of the counter-clockwise arrows in FIG. 7 to create a prying action to assist in removing staple 28. It has been found that only a short tool activation time (burst) is required to remove most staples and often no prying lotion of the power tool is required. For very stubborn staples, as in tense hardwood, handle 15 allows shaft 11 to be rotated around its longitudinal axis to "twist" the staple to help free it. Thus, three separate actions can be applied to a staple during removal. In most upholstery operations during the removal of old staples, the time saved is between sixty and eighty percent over using a conventional manual staple remover as shown in FIGS. 3 and 4. While staples are described above for removal purposes, nails, tacks, brads and other means for attachment can also be removed with staple remover 10.

While the preferred form of the invention is shown, variations will be made by those skilled in the art without departing from the scope of the appended claims and the illustrations and examples provided herein are merely for explanatory purposes.

I claim:

1. A staple remover comprising: a shaft, said shaft having distal and proximal ends, said distal end angled to said shaft, a stop, said stop attached to said proximal end of said shaft, a handle, said handle affixed to said shaft between said stop and said distal end.

2. The staple remover of claim 1 wherein said handle is attached at an approximate right angle to said shaft.

3. The staple remover of claim 1 wherein said stop is circular.

4. The staple remover of claim 1 wherein said angled distal end is forked.

5. The staple remover of claim 4 wherein said distal end comprises a pair of tines.

6. The staple remover of claim 1 wherein said distal end is angled upwardly to said shaft.

7. A staple remover comprising: a rigid shaft, said shaft comprising a tapered distal end, said distal end angularly affixed to said shaft, said tapered distal end comprising a pair of tines, a stop, said stop affixed to said proximal end of said shaft, a handle, said handle positioned perpendicularly to said shaft between said stop and said distal end.

8. The staple remover of claim 7 wherein said shaft is formed from steel.

9. The method of removing a staple with a staple remover having a shaft with a tapered distal end, a proximal end and a handle therebetween comprising the steps of:

(a) grasping the staple remover at the proximal end with one hand;

(b) grasping the handle with the other hand;

(c) positioning the distal end of the shaft proximate a staple to be removed;

(d) urging the distal end under the staple; and (e) moving the handle to rotate the shaft to loosen and remove the staple.

10. The method of claim 9 further comprising the step of inserting the staple remover into a power tool.

11. The method of claim 9 wherein inserting the staple remover comprises the step of inserting the shaft in a pneumatic power tool.

12. The method of claim 9 wherein positioning the distal end comprising the step of positioning the distal end under a set staples.

13. The method of claim 10 further comprising the step of rotating the shaft within the power tool to twist the staple.

14. The method of claim 9 further comprising the step of prying the staple.

* * * * *